United States Patent [19]

Morrison, III et al.

[11] 4,334,452

[45] Jun. 15, 1982

[54] PLASTIC MUSICAL INSTRUMENT BODY HAVING STRUCTURAL INSERT

[75] Inventors: White H. Morrison, III, Franklin, Tenn.; Everette L. Vest, High Point, N.C.

[73] Assignee: Norlin Industries, Inc., White Plains, N.Y.

[21] Appl. No.: 158,536

[22] Filed: Jul. 11, 1980

[51] Int. Cl.[3] ..... G10D 1/08; G10D 3/00; G10H 3/18

[52] U.S. Cl. ..... 84/1.16; 84/267; 84/291; 84/293

[58] Field of Search ..... 84/1.16, 267, 291, 293

[56] References Cited

U.S. PATENT DOCUMENTS

| | | | |
|---|---|---|---|
| 1,881,229 | 10/1932 | Young | 84/291 |
| 3,440,919 | 4/1969 | Baker | 84/291 |
| 3,474,697 | 10/1969 | Kaman | 84/267 |
| 3,691,285 | 9/1972 | Larrison | 84/1.16 |
| 4,027,570 | 6/1977 | Rendell et al. | 84/293 |
| 4,088,050 | 5/1978 | Appel | 84/267 |
| 4,144,793 | 3/1979 | Solka et al. | 84/291 |
| 4,149,442 | 4/1979 | Boshco | 84/1.16 X |
| 4,161,130 | 7/1979 | Lieber | 84/267 |
| 4,185,534 | 1/1980 | Cove | 84/291 |
| 4,188,850 | 2/1980 | Kaman | 82/291 |
| 4,213,370 | 7/1980 | Jones | 84/291 |
| 4,254,683 | 3/1981 | Nulman | 84/1.16 |

*Primary Examiner*—S. J. Witkowski

*Attorney, Agent, or Firm*—Ronald J. Kransdorf

[57] ABSTRACT

A plastic body for a solid body musical instrument such as an electric guitar which body consists of a plastic body molded in the shape of the musical instrument body and a structural support member of wood or other suitable material embedded within the plastic body. The structural support member has a profile shape which is substantially a reduced scale version of the profile shape of the body and is so dimensioned and positioned within the body that the thickness of plastic about the structural member at most points along the member is substantially minimized and the mass of plastic material on one side of the member is not substantially greater than the mass of plastic on the opposite side of the member. The body is adapted to have an electric pickup mounted thereon, the support member being exposed in the area thereof adjacent the pickup and the pickup being mounted in close proximity to the exposed portion of the member.

19 Claims, 7 Drawing Figures

46
42
44

74
78
10

10
7
7
78
74
70
72
14

PLASTIC MUSICAL INSTRUMENT BODY HAVING STRUCTURAL INSERT

BACKGROUND OF THE INVENTION

This invention relates to musical instrument components and more particularly to a plastic body for a solid body electric guitar or similar instrument.

Bodies for solid body electric guitars, electric basses and similar instruments have heretofore normally been formed from a solid piece of wood or by laminating together several pieces of wood. In order to obtain a quality acoustic response and an aesthetically pleasing appearance, it has been necessary to use fairly high quality grades of maple, mahogany and other hard woods for these guitar bodies and there has been significant amounts of time and labor in carving the wood to the proper shape and dimensions, routing or otherwise forming recesses to receive pickups and other electronic hardware, staining and finishing the instrument, polishing the instrument and the like. Many of these steps are most advantageously performed by hand making it difficult to adopt low-cost mass production techniques to the manufacture of these bodies. The resulting high cost of these bodies has been a significant factor in the increased prices for quality electric solid body guitars. Another disadvantageous characteristic of wood when used as a guitar body is that it is subject to warping or cracking and to general deterioration as a result of age and as a result of changes in temperature, humidity, weather and other environmental conditions.

In an effort to reduce the cost of guitar bodies and to overcome the other problems indicated above, efforts have been made to cast or mold guitar bodies out of various plastic materials. While the cost of the plastic is as high or higher than that of wood, there is significantly less labor involved in molding a guitar body as compared to conventionally forming the same body out of wood. However, efforts to mold guitar bodies from plastic materials have presented a number of problems. A typical electric guitar has six strings which may be strung to a tension of about 120 lbs. If the plastic is made hard enough so as not to bow under this tension, the plastic is frequently brittle and the instrument susceptible to breakage. If a softer, more durable plastic is used, the body tends to bow slightly under string tension making it impossible to keep the instrument in tune. It is also difficult to anchor the screws securing the neck, tail piece, and bridge to the body in certain plastics resulting in these elements being pulled loose under string tension.

Another problem with plastic guitar bodies is to obtain from them the tone, resonent and sustain characteristics of a wooden body. Since musicians are accustomed to the sound characteristics of a wooden guitar body, any instrument that did not sound the same as, or similar to a wood-body instrument would not be acceptable to the playing public. While an all plastic body can have many of the same sound characteristics as a wooden body, it is difficult to get it to have all of the same tonal characteristics.

Another problem in molding guitar bodies is that the plastic shrinks as it cures. While the amount of this shrinkage is reasonably predictable, there are certain variations which result in slight dimensional instability in the resulting parts. This can cause problems when the bodies are to be mated with other components such as pickups and necks.

SUMMARY OF THE INVENTION

For the reasons indicated above, and others, there has not heretofore been a commercially successful plastic body electric guitar on the market. This invention overcomes the problems indicated above by providing a body for a solid body electric guitar or similar solid body musical instrument which is molded of a plastic material in the shape of a guitar body or other musical instrument body which is desired. A structural support member which is preferably formed of wood is embedded within the plastic body. In order to achieve the desired acoustic characteristics for the body, a portion of the wooden support member underlying or otherwise adjacent to the pickup of the guitar is left exposed and means are provided for mounting the pickup in close proximity to the exposed portion of the support member. As noted above, one problem with plastic material in general, and with thermoset plastic materials in particular, is that they shrink during the curing operation. The amount of this shrinkage in a given area is to a large extent a function of the mass of the plastic in that area, the mass in turn being dependent on the length, width and thickness of the plastic material in the area. Therefore, if the plastic on one side of the structural support member is substantially thicker than the plastic on the other side, the thicker side will shrink more than the thinner side, causing rotational forces to be applied to the body which, if great enough can cause the body to bow or result in the plastic cracking and/or pulling away from the structural member. Further, for reasons discussed in more detail later, the material for the wooden insert is significantly less expensive than the plastic materials normally utilized making it desirable to have the support member as large as possible to minimize the amount of plastic utilized. However, it has been found that if the plastic thickness in certain areas is less than $\frac{1}{4}''$, the material may develope stress cracks and may peel or pull away from the support member. To assure good results, a somewhat greater thickness is desirable. In order to over come these problems, the structural member for the preferred embodiment of this invention is shaped and dimensioned and is positioned within the plastic body such that the thickness of plastic material about the structural support member, where there is plastic material, is substantially minimized. The support member preferably has a profile shape which is substantially a reduced scale version of the profile shape of the instrument body. The member is also shaped, dimensioned and positioned within the plastic body such that the mass of plastic material on one side of said member is not substantially greater than the mass of plastic material on the opposite side.

The foregoing and other objects, features and advantages of the invention will be apparent from the following more particular description of a preferred embodiment of the invention as illustrated in the accompanying drawings.

IN THE DRAWINGS

DESCRIPTION OF PREFERRED EMBODIMENTS

Figure 1:
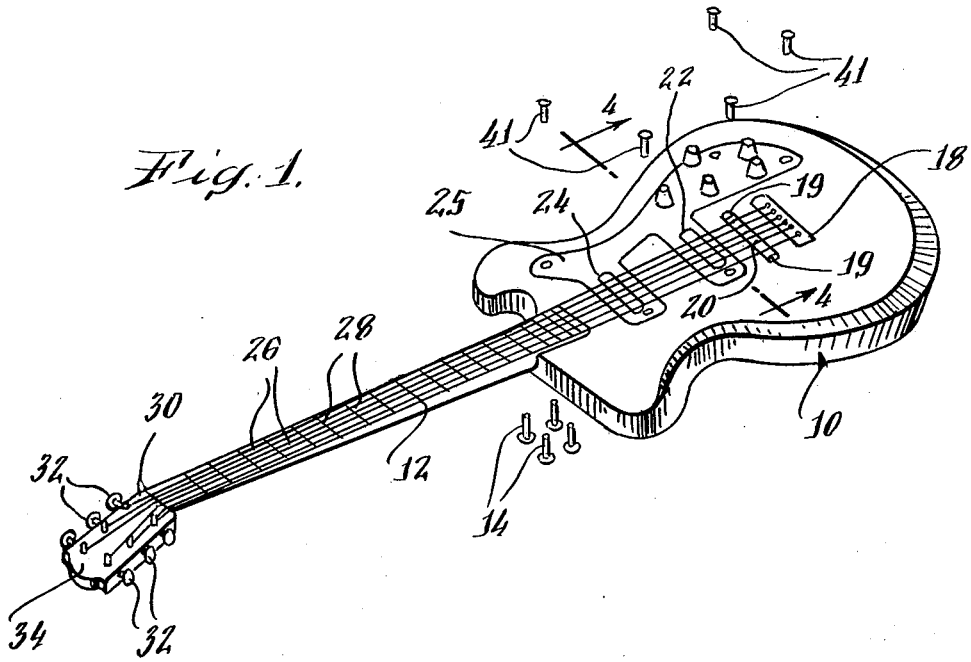
FIG. 1 is a partially exploded perspective view of a solid body electric guitar utilizing the teachings of this invention.
Figure 2:
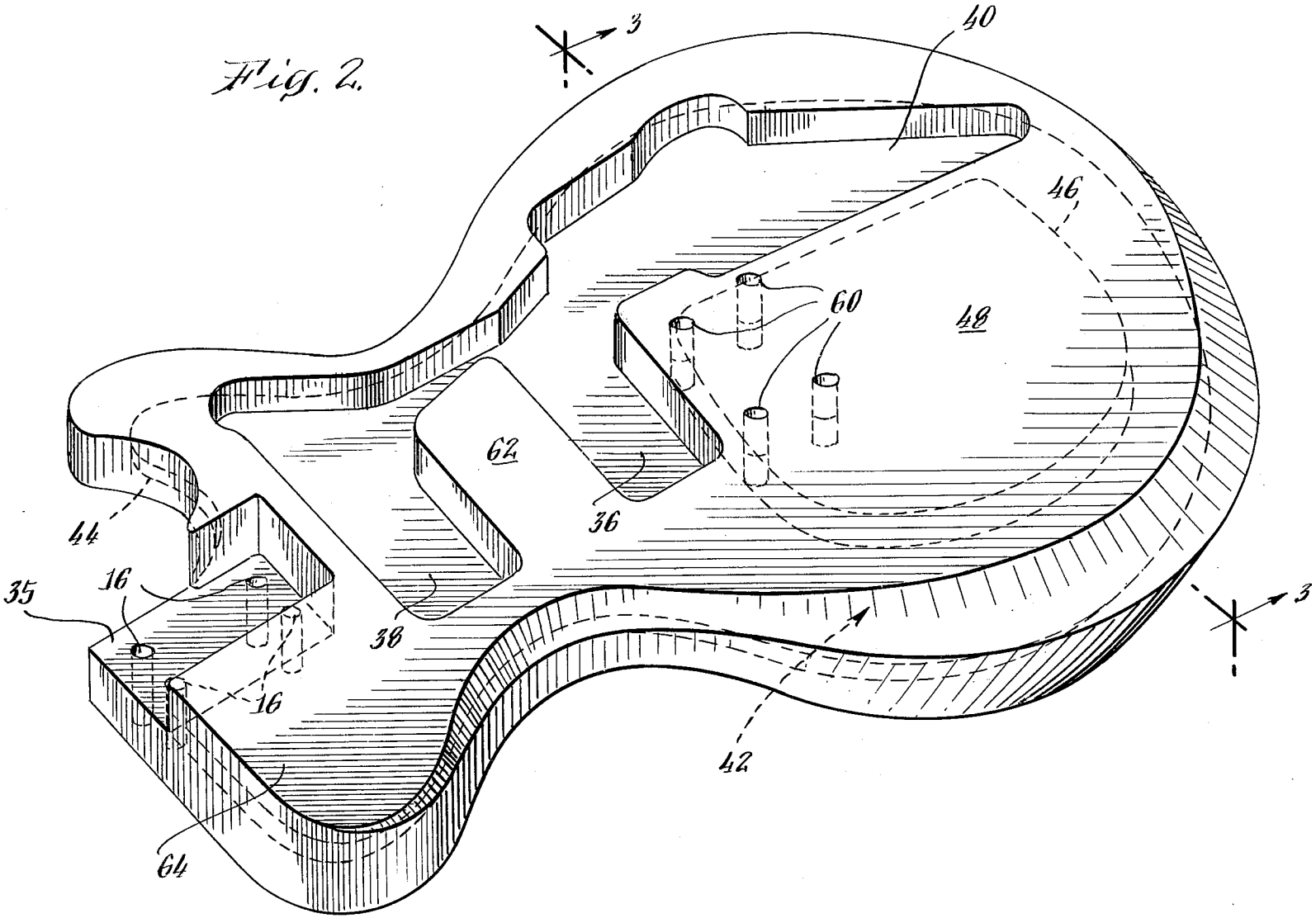
FIG. 2 is a perspective view of the guitar body of this invention.

Referring now to FIG. 1, it is seen that the guitar of the preferred embodiment of this invention includes a body 10 and a neck 12 which is secured to the body by bolts 14. Bolts 14 pass through holes 16 formed in the underside of body 10 and screw into the underside of the neck 12. A tailpiece 18 and bridge 20 are mounted on and secured to body 10 by screws or bolts 19. A pair of electrical pickups 22 and 24 are secured to a cover plate 25 and mounted in body 10 in a manner to be described in more detail later. Strings 26 are secured at one end to tailpiece 18, make contact with the top of bridge 20, pass over pickups 22 and 24 and over frets 28 and head nut 30 on neck 12, being attached at their far end to machine screws 32 in peghead 34. Referring to FIG. 2, body 10 has an opening 35 formed therein which is adapted to receive neck 12, openings 36 and 38 formed therein which are adapted to receive pickups 22 and 24 respectively and opening 40 formed therein which is adapted to receive switches, resistors, and other electronic control components (not shown) which may be used with the instrument. Plate 25 is positioned on and secured to body 10 by screws 41 to cover openings 36, 38 and 40.

Figures 5, 6, 7:
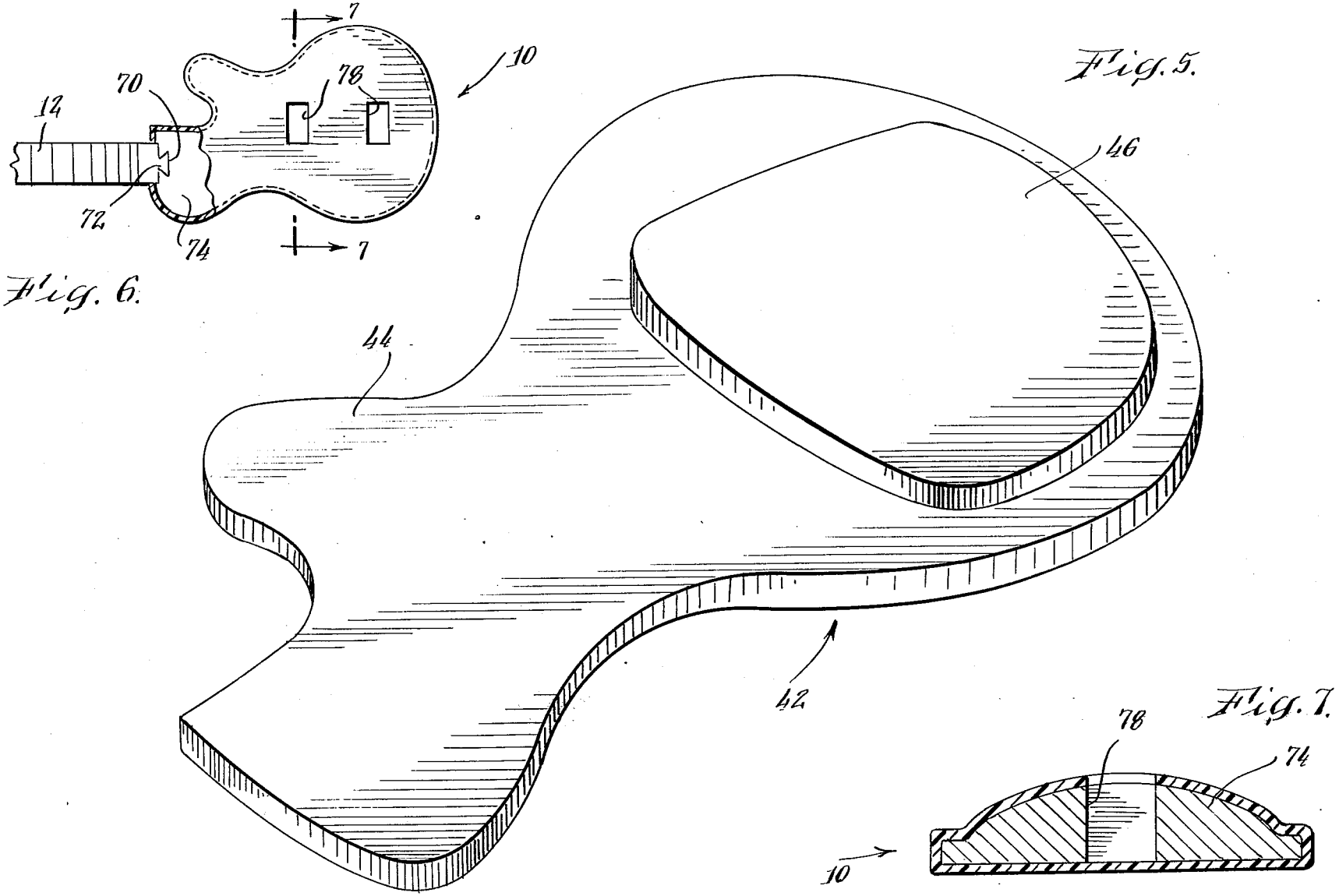
FIG. 5 is a perspective view of structural support members suitable for use in the preferred embodiment of this invention.
FIG. 6 is a partially cut-away top view of a guitar body and a portion of a neck for an alternative embodiment of the invention.
FIG. 7 is a sectional view along the line 7—7 in FIG. 6.

Body 10 is molded in the shape shown in FIG. 2 of a plastic material. While the particular plastic material utilized will vary with the characteristics desired for the instrument body, the material utilized will preferably be a filled polyester thermoset material. Embedded within the body 10 is a structural support member 42 which is best seen in FIG. 5. Referring to FIG. 5, it is seen that the structural support member 42 consists of a first flat member 44 having a profile shape which is substantially a reduced scale version of the profile shape of the body 10, and a small flat member 46 which is secured to the member 44 by gluing or other suitable means. The members 44 and 46 may be of particleboard, metal, graphite, hard plastic, or other structural material, but for optimum acoustical and other results are preferably of wood. In particular, these members are preferably of maple, mahogany, or another hard wood which is normally used for making guitar bodies.

Figure 3:
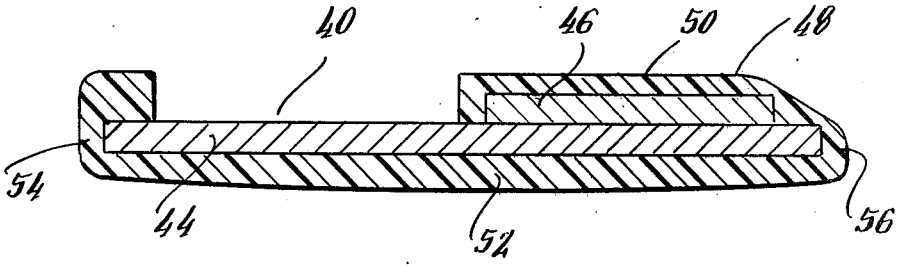
FIG. 3 is a sectional view along the line 3—3 of FIG. 2.
Figure 4:
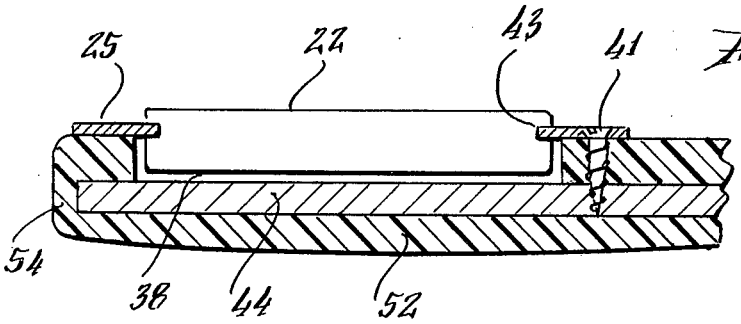
FIG. 4 is a sectional view along the line 4—4 of FIG. 1.

Referring now to FIGS. 2–4, it is seen that the structural support member 42 is fully embedded within the body 10 except for the openings 35, 36, 38, and 40 where the wood of structural support member 42 is exposed. Pickup 22 is mounted in plate 25 and is held therein by the plate fitting in a groove 43 formed in the pickup or by other suitable means. Plate 25 is mounted on body 10 and held therein by screws 41 in a position such that pickup 22 is positioned in close proximity to support member 44. The magnetic field of pickup 22 radiates from either the top or bottom or the pickup around the outside of the pickup and in the opposite end. Therefore, both the strings of the instrument and the body 10 pass through the magnetic field and vibrations of these members are picked up by the field and reproduced. Since the wooden support member 44 is in close proximity to the underside of pickups 22 and 24 (a cross section through pickup 24 being substantially the same as shown in FIG. 4), this is the portion of the body which most clearly influences the magnetic field. Since the resonant, sustain, and other tonal characteristics of this portion of the body are the same as those of a wooden body instrument, the tonal characteristics of the guitar body of this invention are substantially the same as those of a wooden body instrument.

Referring still to FIGS. 3 and 4, it is seen that support members 44 and 46 are dimensioned, shaped and positioned so as to minimize the amount of plastic material required for the body and to minimize the differences in plastic thickness on opposite sides of the support members. In particular, thicknesses 50, 52, 54, and 56 are maintained as thin as possible without causing stress fractures, peeling or pulling away and are maintained substantially equal. While a minimum of $\frac{1}{4}''$ would be required for these thicknesses in order to avoid any potential tolerance problems, it is preferable to maintain these thicknesses at about $\frac{3}{8}''$.

The wooden structural support member 42 performs a number of functions in body 10. First, while this member is formed of the same type of wood as is used for guitar bodies, it does not need to be made of a high grade of this wood since it is completely covered within the plastic body and does not contribute to the aesthetics of the instrument. Therefore, relatively inexpensive wood, including scrape wood, can be used for these members. This wood is substantially less expensive than the filled polyester thermoset material which is utilized for the remainder of the body and its use therefore serves to reduce the overall cost of the body. It basically serves as an inexpensive filler.

For optimum reductions in cost, member 42 should obviously be as large and thick as possible and the thickness of plastic material minimized. However, as previously indicated, if the mass of plastic on the body is not totally uniform, then a thickness of plastic material at any point of less than $\frac{1}{4}''$ may cause the plastic material to develope stress cracks and to peel or pull away from the wood support member. To be on the safe side, it has been found that minimum thickness areas such as areas 50, 52, 54 and 56 should be about $\frac{3}{8}''$.

Second, as indicated above, having a reasonably large piece of wood inside the instrument body and, in particular, having the electric pickups of the instrument mounted in close proximity to an exposed portion of the wood member permitting the magnetic field of the pickup to pass undistorted by other medium through the wood, provides the body with resonant, sustain and other tonal characteristics which are substantially the same as those of a wood guitar body. These effects can be further enhanced by selecting the plastic material to have a density and specific weight which closely approximates that of the wood being utilized.

Third, the support member 42 provides structural support for the body preventing it from bowing under the forces applied to it as a result of tension on strings 26. As indicated previously, without member 42, the plastic body would tend to bow under these forces making it impossible to keep the instrument in tune. Countersinks 60 are provided in members 44 and 46 after the body is molded. Screws 19 for anchoring bridge and tailpiece 18 and 22 are anchored in these countersinks providing a solid anchoring for these elements and preventing them from being pulled from the body as a result of string tension. Similarly, the bolts 14 for anchoring neck 12 to the body 10 pass through holes 16 formed after the molding operating has been completed, holes 16 passing through member 44, providing a more secure joining of the neck to the body.

Finally, a filled polyester thermoset plastic would normally shrink approximately ¼" per lineal foot in each direction (ie. length, width and thickness) during the curing operation. The presence of member 42 within the body makes the shrinkage more predictable and reduces the shrinkage to roughly 1/16 of an inch overall both because the wood holds the plastic against shrinkage and because there is significantly less plastic involved to shrink. By maintaining the mass of plastic on opposite sides of the member 42 substantially uniform, there is not significantly more shrinkage on one side of the member than on the other minimizing rotational forces on the body and minimizing the possibility that the body will crack or otherwise separate from the support member. In particular, the member 46 underlying large area 48 of the body minimizes the mass differential on opposite sides of member 42 as well as minimizing the amount of plastic required to form the body. In areas 35, 36, 38 and 40, the amount of plastic under member 44 should be minimized, being no more than ⅜", to prevent an excess of shrinkage differential. While it is noted that in areas 62, and 64 of the body, the thickness of plastic above member 42 is substantially greater than the thickness of the plastic below, these areas are of relatively small size and therefore the amount of additional shrinkage above the member 42 in these areas as opposed to that below is not sufficient to cause any problem. If it were found that problems did result from excessive shrinkage in these two relatively small areas, an additional support member such as support member 46 could be added in these areas.

Another advantage of the body construction of this invention is that the wooden structural insert is enclosed within the plastic body minimizing the acquisition or loss of moisture from the wood. The plastic also holds the wood against warpage. The body is therefore relatively impervious to variations in temperature and humidity and to the effects of rot or drying out with age. The instrument body thus has excellent reliability and durability.

To fabricate the body 10, a mold of rubber or other suitable material in the shape of the body 10 is provided. The inside walls of the mold may have a slight wood graining formed therein to enhance the wood-like appearance of the resulting body or may have other designs, writings or the like formed therein. Members 44 and 46 are then secured together by gluing or other means and are positioned in the mold in a manner so as to make areas 50, 52, 54 and 56 substantially uniform. Member 42 may be held in the desired position in the mold by passing a number of icepick-like pins or other suitable thin elements through the mold to a predetermined depth and into contact with the member 42. The tips of the pins could be embedded slightly in the member. Three pins have been found to be adequate for this purpose. If a porous wood such as maple is used for the member 42, the plastic material will seep into the grain and pores of the wood enough to provide good adhesion. If a harder wood is used for member 42, it may be desirable to rough the wood slightly to improve adhesion. The filled polyester thermoset material is then poured into the mold and permitted to set. After the material has set sufficiently to support the weight of member 42, but before the material has become fully set, the pins are removed. When the body has completely jelled and partially cured, it is removed from the mold and laid aside to completely cure. The holes left in the body by the pins are then filled in standard fashion. The body is then washed and may be painted, stained, or otherwise finished if desired.

While for the preferred embodiment of the invention described above, neck 12 has been bolted through support member 44 to body 10, FIG. 6 shows an alternative embodiment of the invention wherein a male vertical dovetail 70 is formed at the end of neck 12 and a mating female dovetail 72 is formed in wood structure support member 74. Neck 12 is dovetail joined to member 74 before member 74 is inserted in the mold and the two elements are then molded together to provide a secure joint between the neck and body.

Further, while for the preferred embodiment of the invention, pickups 22 and 24 are mounted so as to have only one side of the pickup adjacent to wooden support member 44, in a standard electric guitar five sides of the pickup are in juxtaposition with wood. If desired, a similar result can be achieved with the guitar body of this invention by using a slightly thicker piece of wood 44 and forming a recess in the wood in which all or a portion of the pickup would fit.

FIGS. 6 and 7 illustrate another alternative embodiment of the invention in which the recesses described above pass all the way through structural support member 74. In this embodiment of the invention the top of body 10 is arched and member 74 is similarly arched so as to maintain the thickness of plastic material above and below member 74 substantially uniform. Two openings 76 and 78 are formed in the top of body 10 and extend completely through member 74. Pickups 22 and 24 (see FIG. 1) are mounted in a cover plate 25 such as shown in FIG. 1 and the cover plate is secured to the top of body 10 in a manner such that the pickups are positioned in the openings 76 and 78 respectively in the body and the wooden support member, but do not make contact with any portion of the body. The pickups are thus each surrounded on four sides by wood and function as with the embodiment of FIGS. 1–5 to provide a wood-sounding acoustic output.

While preferred embodiments of the invention have been described above, it is to be understood that the foregoing and other changes may be made in form and detail without departing from the spirit and scope of the invention as defined in the following claims.

What is claimed is:

1. A solid body for a stringed musical instrument, said body having a predetermined shape including a profile shape, comprising:

a body molded of a plastic material in the shape of said musical instrument body; and a structural support member substantially embedded within said plastic body, said member having a profile shape and being dimensioned such that it is generally a reduced scale version of the profile shape of said body.

2. A body as claimed in claim 1 wherein the material of said support member is wood.

3. A body as claimed in claim 1 wherein said instrument has at least one electric pickup member;

wherein the member is exposed in the areas thereof adjacent to said pickup; and including means for mounting said pickup member in close proximity to the exposed portions of said support member.

4. A body as claimed in claim 3 wherein the member is exposed in the area thereof underlying said pickup.

5. A body as claimed in claim 3 including an opening formed in said member, the length and width of which is slightly greater than that of said pickup; and wherein said means for mounting includes means for mounting said pickup within, but not in contact with, said opening.

6. A body as claimed in claim 1 wherein the shape and dimensions of said support member are such that the thickness of the plastic material in which said support member is embedded is substantially minimized at most points about said support member.

7. A body as claimed in claim 6 wherein the thickness of plastic material at any point about said support member is not less than $\frac{1}{4}''$.

8. A body as claimed in claim 1 wherein the shape and dimensions of said body are such that the thickness dimension of said body is greater at some points than at others; and including a second support member secured to said support member in at least the major areas thereof within said points of greater thickness, the combined dimension of said support members being such that the thickness of plastic material at most points about the combined first and second support members is substantially minimized.

9. A body as claimed in claim 8 wherein the shape and dimensions of said support members are such that the mass of the plastic material on any one side of said members is not substantially different from the mass of the plastic material on the opposite side of the members whereby shrinkage of plastic on all sides of said members is substantially uniform.

10. A body as claimed in claim 1 wherein the shape and dimensions of said support member are such that the mass of the plastic material on any one side of said member is not substantially different from the mass of the plastic material on the opposite side of the member whereby shrinkage of plastic on all sides of said member is substantially uniform.

11. A body as claimed in claim 1 wherein said musical instrument is a guitar; and wherein the material of said structural member is a hard wood of the type normally used for manufacturing wooden guitar bodies.

12. A body as claimed in claim 1 wherein said musical instrument is a guitar of the type having a neck secured to one end of the body with a bridge and tailpiece being mounted to the body; and wherein said structural support member is shaped and positioned so as to underlie the areas of said body to which said neck and tailpiece are secured.

13. A body as claimed in claim 12 wherein said guitar has at least one electrical pickup;

wherein the material of said structural support member is wood;

wherein the member is exposed in the area thereof adjacent said pickup; and wherein said pickup is mounted in close proximity to the exposed portion of said wooden support member.

14. A body as claimed in claim 1 wherein said musical instrument is of the type having a neck secured to one end thereof;

wherein said neck and member have mating joints formed therein; and wherein the plastic material of the body is molded about the joint of said neck and member to secure the neck to the body.

15. A body as claimed in claim 2 wherein the density and specific weight of said plastic material closely approximates that of the wood utilized for said support member.

16. A body for a solid body electric musical instrument having a predetermined shape including a profile shape and having at least one electrical pickup comprising:

a body molded of a plastic material in the shape of the body for the instrument;

a wooden structural support member embedded within said plastic body, said member being exposed in the area thereof adjacent said pickup; and means for mounting said pickup in close proximity to the exposed portion of said wooden support member.

17. A body as claimed in claim 16 wherein the member is exposed in the area thereof underlying said pickup.

18. A body as claimed in claim 16 including an opening formed in said member, the length and width of which is slightly greater than that of said pickup; and wherein said means for mounting includes means for mounting said pickup within, but not in contact with, said opening.

19. A body as claimed in claim 16 wherein the profile shape of said support member is substantially a reduced scale version of the profile shape of said body.

* * * * *